US005545056A

United States Patent [19]

Yamaguchi

[11] Patent Number: 5,545,056

[45] Date of Patent: Aug. 13, 1996

[54] ELECTRICAL CONNECTOR MOUNTING CONSTRUCTION OF ELECTRICAL CONNECTOR HOLDER

[75] Inventor: Jun Yamaguchi, Yokkaichi, Japan

[73] Assignee: Sumitomo Wiring Systems, Ltd, Yokkaichi, Japan

[21] Appl. No.: 374,097

[22] Filed: Jan. 18, 1995

[30] Foreign Application Priority Data

Mar. 11, 1994 [JP] Japan ..... 6-041549

[51] Int. Cl.[6] ..... H01R 13/73

[52] U.S. Cl. ..... 439/532

[58] Field of Search ..... 439/527, 532, 439/552, 717

[56] References Cited

U.S. PATENT DOCUMENTS 3,993,395 11/1976 Taylor ..... 439/717

4,425,018 1/1984 Stenz ..... 439/717

4,466,683 8/1984 Ballarini ..... 439/571

4,469,393 9/1984 Chewning, Jr. et al. ..... 439/717

*Primary Examiner*—Gary F. Paumen

*Attorney, Agent, or Firm*—Greenblum & Bernstein P.L.C.

[57] ABSTRACT

An electrical connector mounting construction of an electrical connector holder including a holder body, comprising: a vertical wall portion for inserting an electrical connector thereinto, which is provided on the holder body; a locking portion for locking the electrical connector, which is provided on the vertical wall portion; a pair of main ribs which are provided on the vertical wall portion so as to be coupled with the holder body; and a pair of auxiliary ribs which are each coupled with an outer side of each of the main ribs and the holder body; the vertical wall portion being formed, at its opposite sides distant from a locking opening of the locking portion, with a pair of slits for drawing a molding die for forming the auxiliary ribs, respectively.

2 Claims, 4 Drawing Sheets

ELECTRICAL CONNECTOR MOUNTING CONSTRUCTION OF ELECTRICAL CONNECTOR HOLDER

BACKGROUND OF THE INVENTION

The present invention generally relates to an electrical connector holder for mounting an electrical connector thereon and more particularly, to an electrical connector mounting construction of the electrical connector holder, which is capable of increasing holding force for the electrical connector.

Electrical connectors coupled with wiring harnesses for a motor vehicle are, for example, inserted into electrical connector mounting portions of a junction box, a relay box, an electrical connector holder, etc. so as to be mounted on the electrical connector mounting portions.

FIG. 1 shows a known electrical connector 1 of this kind. In order to mount the known electrical connector 1 on a prior art electrical connector holder shown in FIGS. 2 and 3, the known electrical connector 1 is provided with a pair of slide shoes la and a locking claw 1*b*.

Meanwhile, the prior art electrical connector holder is made of synthetic resin and includes a holder body 2. The holder body 2 has a vertical wall portion 2*a* such that the slide shoes la of the known electrical connector 1 are inserted into opposite sides of the vertical wall portion 2*a*, respectively, in the direction of the arrow A. The holder body 2 further has a locking portion 2*b* formed at an upper central portion of the vertical wall portion 2*a* in the direction of the arrow A. The locking portion 2*b* is constituted by a projecting engageable pawl 2*b*-l 1 engageable with the locking claw 1*b* and a locking opening 2*b*-2 disposed below the engageable pawl 2*b*-1.

Since the slide shoes la are inserted into the vertical wall portion 2*a*, the vertical wall portion 2*a* has a quite small wall thickness of, for example, about 0.8 mm and thus, the vertical wall portion 2*a* should be reinforced. To this end, a pair of ribs 2*e* are provided on a rear face 2*c* of the vertical wall portion 2*a* so as to extend in the direction of the arrow A at opposite sides of the locking portion 2*b* such that lower end portions of the ribs 2*e* are coupled with the holder body 2.

However, even if only the ribs 2*e* are provided, strength of the vertical wall portion 2*a* is low, so that the vertical wall portion 2*a* is likely to be deformed when the known electrical connector 1 is mounted on or detached from the prior art electrical connector holder. As a result, such a problem arises that due to a drop of holding force for the known electrical connector 1, the known electrical connector 1 is readily detached from the prior art electrical connector holder.

In order to further increase strength of the vertical wall portion 2*a*, an upper portion or a side portion of the rib 2*e* may be coupled with the holder body 2. However, since the holder body 2 is formed with the locking opening 2*b*-2, molding dies 10A and 10B for molding the holder body 2 are split as shown in FIG. 4. Therefore, it is difficult to form a coupling portion between the ribs 2*e* and the holder body 2.

If a slit for drawing the molding dies is formed on the vertical wall portion 2*a*, it is possible to form a coupling portion for coupling the ribs 2*e* with the holder body 2. However, if the slit is disposed adjacent to the locking opening 2*b*2, strength of the vertical wall portion 2*a* in the vicinity of the locking opening 2*b*-2 drops undesirably.

SUMMARY OF THE INVENTION

Accordingly, an essential object of the present invention is to provide, with a view to eliminating the above mentioned drawbacks of the prior art, an electrical connector mounting construction of an electrical connector holder, which increases the holding force for an electrical connector and improves safety of operation for mounting the electrical connector on the electrical connector holder.

In order to accomplish this object of the present invention, an electrical connector mounting construction of an electrical connector holder including a holder body, according to the present invention comprises: a vertical wall portion for inserting a slide shoe of an electrical connector in a connector inserting direction, which is provided on the holder body; a locking portion which is engageable with a locking claw of the electrical connector at a predetermined insertion position of the electrical connector and is provided at an upper portion of the vertical wall portion in the connector inserting direction; a pair of main ribs which are, respectively, provided at opposite sides of the locking portion on a rear face of the vertical wall portion and extend in the connector inserting direction so as to be coupled with the holder body; and a pair of auxiliary ribs which each have one end coupled with an outer side of each of the main ribs so as to be spaced from the rear face of the vertical wall portion by a gap for allowing insertion of the slide shoe of the electrical connector thereinto and extend in a direction perpendicular to the connector inserting direction such that the other end of each of the auxiliary ribs is coupled with the holder body; the vertical wall portion being formed, at its opposite sides, with a pair of slits for drawing towards a front face of the vertical wall portion a molding die for forming the auxiliary ribs, respectively.

By the above described arrangement, since the outer side of each of the main ribs is coupled with the holder body by each of the auxiliary ribs, the vertical wall portion is reinforced, so that the holding force for the electrical connector is improved and thus, the electrical connector is less likely to be detached from the electrical connector holder. Meanwhile, since the slits for drawing the molding die for forming the auxiliary ribs are formed at positions distant from the locking portion, namely, at the opposite sides of the vertical wall portion, drop of the strength of the locking portion can be prevented.

Furthermore, since the slits are not formed at an upper end of the vertical wall portion, an operator is least likely to touch the edges of the slits with his hand during mounting of the electrical connector on the electrical connector holder, thereby resulting in improvement of operational safety.

Moreover, since the slits can be formed at the opposite sides of the vertical wall portion, restrictions on width of the the slits are lightened and thus, strength of the the vertical wall portion can be set in accordance with applications of the electrical connector holder.

Meanwhile, it is preferable that the locking portion includes an obliquely projecting engageable pawl and a locking opening formed below the engageable pawl and the engageable pawl is brought into contact with the locking claw of the electrical connector such that a distal end of the locking claw is inserted into the locking opening.

By the above mentioned arrangement, engagement between the electrical connector holder and the electrical connector can be performed more firmly.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
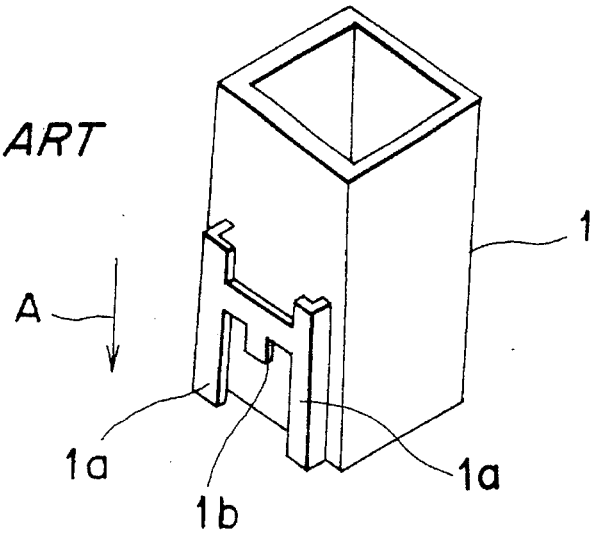
Fig. 1 PRIOR ART
FIG. 1 is a perspective view of a prior art electrical connector (already referred to)
Figure 2:
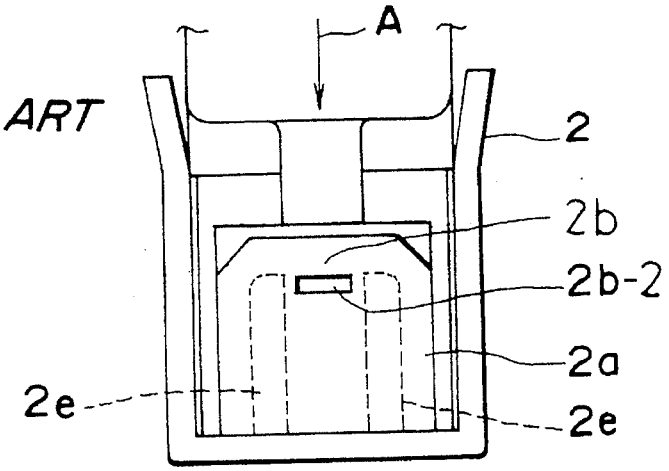
Fig. 2 PRIOR ART
FIG. 2 is a front elevational view of a prior art electrical connector holder (already referred to)
Figure 3:
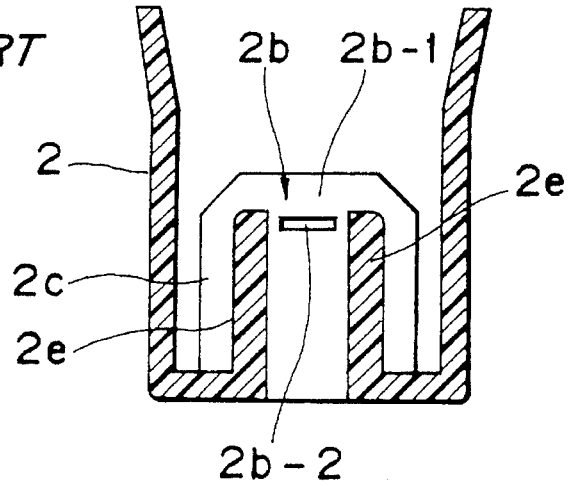
Fig. 3 PRIOR ART
FIG. 3 is a sectional view of the prior art electrical connector holder of FIG. 2 (already referred to)
Figure 4:
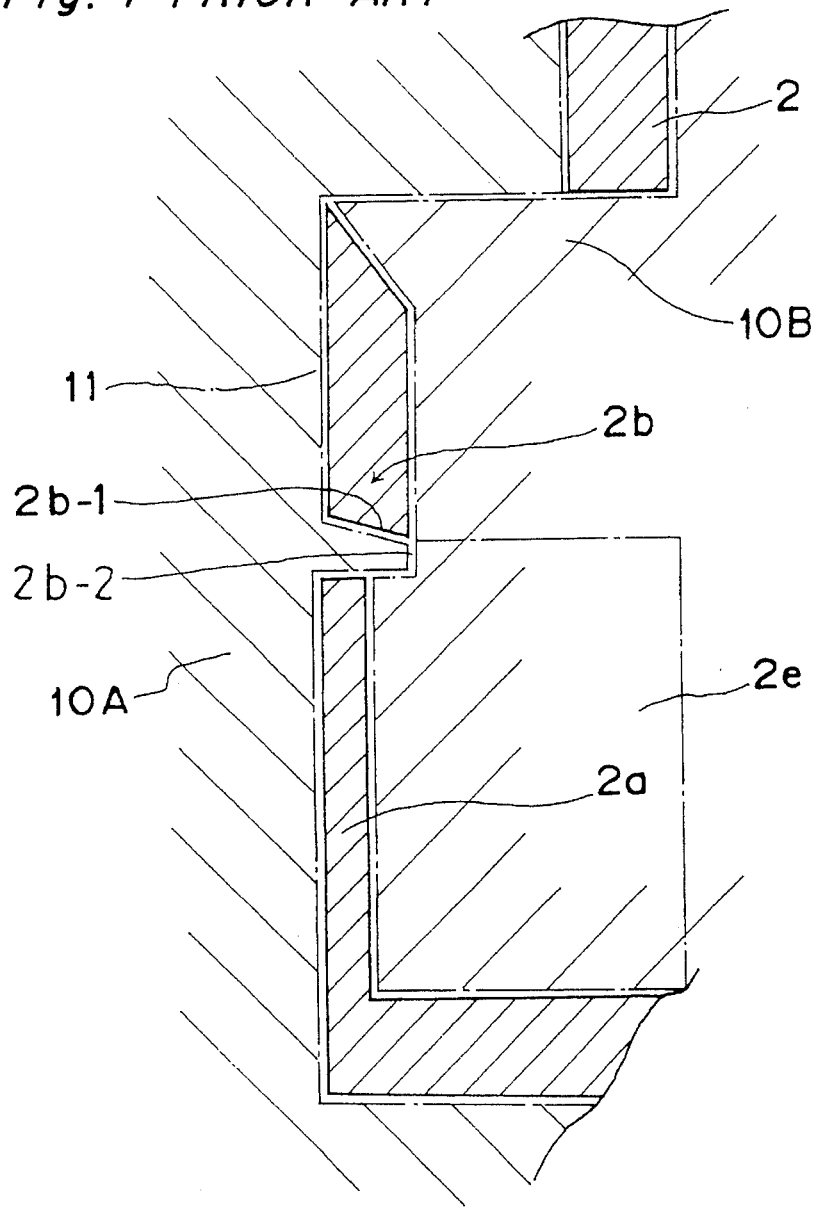
Fig. 4 PRIOR ART
FIG. 4 is an enlarged fragmentary sectional view showing split molding dies for molding the prior art electrical connector holder of FIG. 2 (already referred to)
Figure 8:
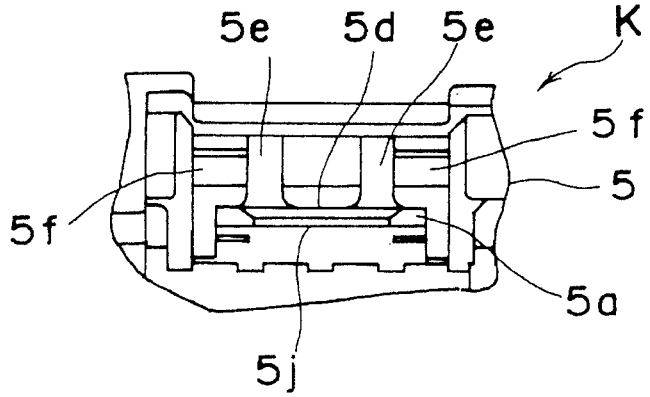
FIG. 8 is a fragmentary top plan view of the electrical connector holder of FIG. 5.
Figure 5:
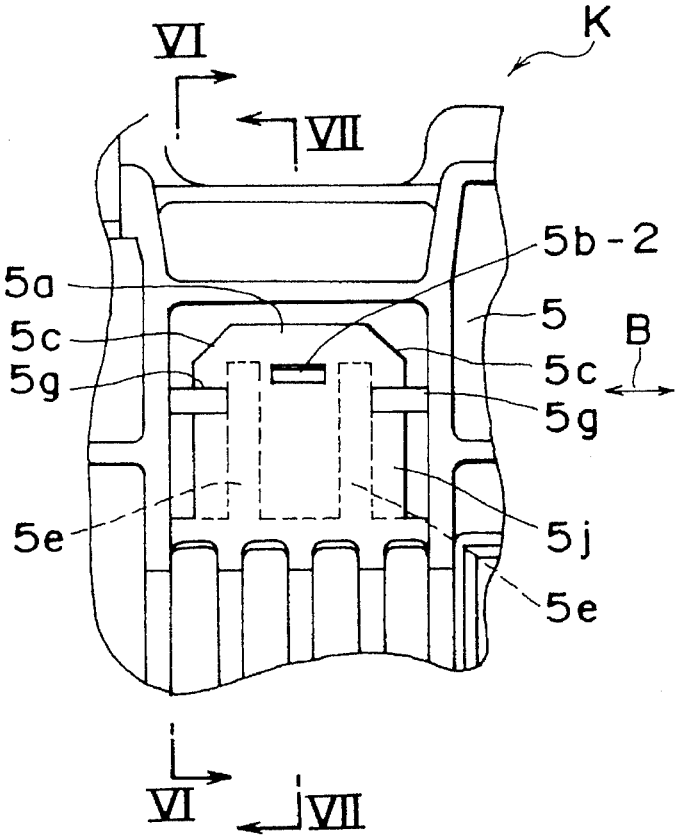
FIG. 5 is a fragmentary front elevational view of an electrical connector holder according to the present invention.
Figure 6:
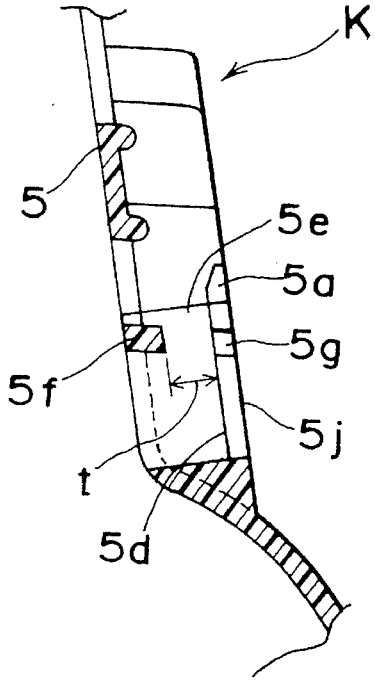
FIG. 6 is a sectional view taken along the line VI—VI in FIG. 5.
Figure 9:
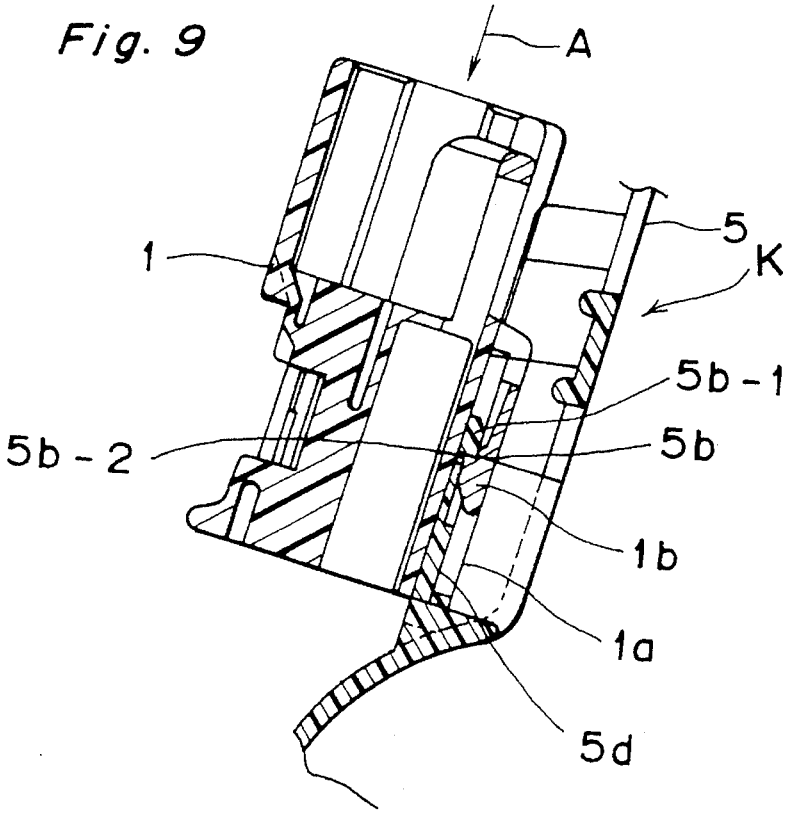
FIG. 9 is a sectional view corresponding to FIG. 7 and showing an electrical connector inserted into the electrical connector holder of FIG. 5.

Referring now to the drawings, there is shown in FIGS. 5 to 9, an electrical connector holder K according to one embodiment of the present invention. The electrical connector holder K is made of synthetic resin and includes a holder body 5. An electrical connector 1 for use with the electrical connector holder 5 is shown in FIG. 9 and is identical with a known electrical connector 1 shown in FIG. 1. Thus, the electrical connector 1 includes a pair of slide shoes la and a locking claw 1*b*.

The holder body 5 is provided with a vertical wall portion 5*a* such that the slide shoes 1*a* of the electrical connector 1 are, respectively, inserted into opposite sides of the vertical wall portion 5*a* in the direction of the arrow A. Furthermore, a locking portion 5*b* is formed at an upper central portion of the vertical wall portion 5*a* in the direction of the arrow A. The locking portion 5*b* is constituted by an obliquely projecting engageable pawl 5*b*-1 engageable with the locking claw 1*b* at a predetermined insertion position of the electrical connector 1 and a locking opening 5*b*-2 formed below the engageable pawl 5*b*-1 such that a distal end of the locking claw 1*b* is inserted into the locking opening 5*b*-2. Chamfered portions 5*c* are formed at opposite sides of an upper end of the vertical wall portion 5*a*, respectively.

Since the slide shoes 1*a* of the electrical connector 1 are inserted into the vertical wall portion 5*a*, the vertical wall portion 5*a* has a quite small wall thickness of, for example, about 0.8 mm. Thus, in order to reinforce the vertical wall portion 5*a*, a pair of main ribs 5*e* are provided on a rear face 5*d* of the vertical wall portion 5*a* so as to extend in the direction of the arrow A at opposite sides of the locking portion 5*b* such that lower end portions of the main ribs 5*e* are coupled with the holder body 5.

Meanwhile, a pair of auxiliary ribs 5*f* are, respectively, provided between an outer side face of one of the main ribs 5*e* and the holder body 5 and between an outer side face of the other of the main ribs 5*e* and the holder body 5 so as to be spaced from the rear face 5*d* by a gap t for allowing insertion of the slide shoes 1*a* of the electrical connector 1 thereinto. Thus, one end of each auxiliary rib 5*f* is coupled with the outer side face of each main rib 5*e*, while the other end of each auxiliary rib 5*f* extends in the direction of the arrow B perpendicular to the direction of the arrow A so as to be coupled with the holder body 5. In order to form a pair of the auxiliary ribs 5*f*, a pair of slits 5*g* for drawing towards a front face 5*j* of the vertical wall portion 5*a* a molding die for forming the auxiliary ribs 5*f* are, respectively, formed at opposite sides of the vertical wall portion 5*a*.

By the above described arrangement, the auxiliary ribs 5*f* coupled with the main ribs 5*e* of the vertical wall portion 5*a* of the holder body 5 are provided at positions far from the locking opening 5*b*-2, namely, at an outer side of each main rib 5*e*. Thus, since the slits 5*g* for drawing the molding die for forming the auxiliary ribs 5*f* can be formed at the opposite sides of the vertical wall portion 5*a*, which are distant from the locking opening 5*b*-2, the slits 5*g* are made distant from the locking opening 5*b*-2, so that the strength of the locking portion 5*b* is not reduced. Furthermore, since the strength of the vertical wall portion 5*a* is increased by the auxiliary ribs 5*f*, the holding force for the electrical connector 1 is improved and thus, the electrical connector 1 is less likely to be detached from the electrical connector holder K.

Meanwhile, since the slits 5*g* are not disposed at an upper end of the vertical wall portion 5*a*, an operator is least likely to touch the edges, etc. of the slits 5*g* with his hand during mounting of the electrical connector 1 on the electrical connector holder K, thereby resulting in improvement of operational safety. In addition, since the slits 5*g* can be formed at opposite sides of the vertical wall portion 5*a*, restrictions on the width of the slits 5*g* are lightened and thus, the strength of the vertical wall portion 5*a* can be set in accordance with applications of the electrical connector holder K.

Figure 7:
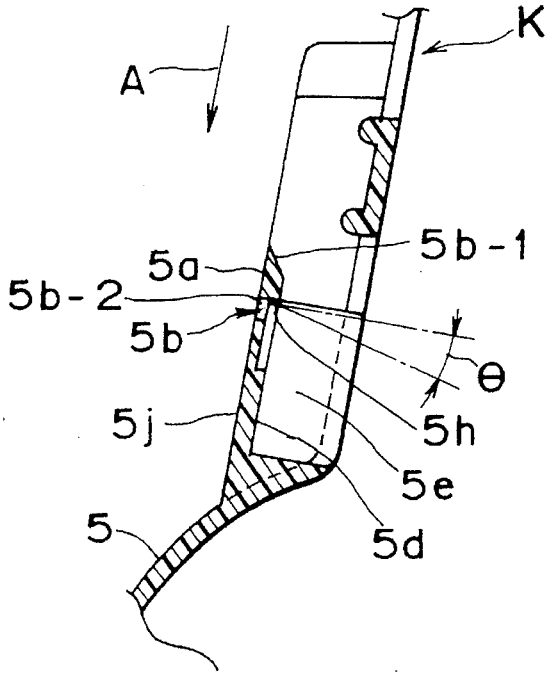
FIG. 7 is a sectional view taken along the line VII—VII in FIG. 5.

In order to increase the strength of the vertical wall portion 5*a*, the locking opening 5*b*-2 may be replaced by a locking recess. However, in this case, since an undercut portion 5*h* having an angle θ of, for example, 15° for making the locking claw 1*b* less likely to be detached from the electrical connector holder K as shown in FIG. 7 cannot be formed at the locking portion 5*b*, thereby resulting in a drop of holding force for the electrical connector 1. In this embodiment, the holding force for the electrical connector 1 is increased by forming the undercut portion 5*h* at the locking opening 5*b*-2. Furthermore, by increasing the strength of the locking portion 5*b*, the holding force for the electrical connector 1 can be further increased.

The slits may also be formed at an upper end of the vertical wall portion such that the upper ends of the main ribs and the holder body are coupled with each other by the auxiliary ribs. However, in this case, since the slits are disposed adjacent to the locking opening 5*b*-2, the strength of the locking portion 5*b* is lower than that of the embodiment. Therefore, it is desirable that the auxiliary rib for coupling the main rib and the holder body is provided at the side of the main rib.

As is clear from the foregoing description of the electrical connector mounting construction of the electrical connector holder of the present invention, the outer side face of each main rib and the holder body are coupled with each other by each auxiliary rib and the slits for drawing the molding die for forming the auxiliary ribs are formed at the opposite sides of the vertical wall portion. Therefore, since the holding force for the electrical connector is increased without lowering the strength of the locking portion, the electrical connector is less likely to be detached from the electrical connector holder.

Meanwhile, since the operator is least likely to touch the slits with his hand during mounting of the electrical connector on the electrical connector holder, operational safety is improved. In addition, since restrictions on the width of the slits are lightened, the strength of the vertical wall portion can be set in accordance with applications of the electrical connector holder.

What is claimed is:

1. An electrical connector mounting construction of an electrical connector holder including a holder body, comprising:

a vertical wall portion for inserting a slide shoe of an electrical connector in a connector inserting direction, which is provided on the holder body;

a locking portion which is engageable with a locking claw of the electrical connector at a predetermined insertion position of the electrical connector and is provided at an upper portion of the vertical wall portion in the connector inserting direction;

a pair of main ribs which are, respectively, provided at opposite sides of the locking portion on a rear face of the vertical wall portion and extend in the connector inserting direction so as to be coupled with the holder body; and a pair of auxiliary ribs which each have one end coupled with an outer side of each of the main ribs so as to be spaced from the rear face of the vertical wall portion by a gap for allowing insertion of the slide shoe of the electrical connector thereinto and extend in a direction perpendicular to the connector inserting direction such that the other end of each of the auxiliary ribs is coupled with the holder body;

the vertical wall portion being formed, at its opposite sides, with a pair of slits for drawing towards a front face of the vertical wall portion a molding die for forming the auxiliary ribs, respectively.

2. An electrical connector mounting construction as claimed in claim 1, wherein the locking portion includes an obliquely projecting engageable pawl and a locking opening formed below the engageable pawl, wherein the engageable pawl is brought into contact with the locking claw of the electrical connector such that a distal end of the locking claw is inserted into the locking opening.

* * * * *